US008845358B2

(12) United States Patent
Kitagawa

(10) Patent No.: US 8,845,358 B2
(45) Date of Patent: Sep. 30, 2014

(54) CABLE CONNECTOR

(71) Applicant: Kyocera Connector Products Corporation, Kanagawa (JP)

(72) Inventor: Naoki Kitagawa, Kanagawa (JP)

(73) Assignee: Kyocera Connector Products Corporation, Kanagawa (JP)

( * ) Notice: Subject to any disclaimer, the term of this patent is extended or adjusted under 35 U.S.C. 154(b) by 0 days.

(21) Appl. No.: 13/779,849

(22) Filed: Feb. 28, 2013

(65) Prior Publication Data

US 2013/0224986 A1 Aug. 29, 2013

(30) Foreign Application Priority Data

Feb. 28, 2012 (JP) ..... 2012-041026

(51) Int. Cl.
*H01R 13/627* (2006.01)
*H01R 12/79* (2011.01)
*H01R 12/77* (2011.01)

(52) U.S. Cl.
CPC ..... *H01R 13/627* (2013.01); *H01R 12/79* (2013.01); *H01R 12/774* (2013.01)
USPC ..... 439/357

(58) Field of Classification Search
USPC ..... 439/357, 352, 328, 329, 327, 326, 153, 439/495, 260
See application file for complete search history.

(56) References Cited

U.S. PATENT DOCUMENTS 4,872,853 A * 10/1989 Webster ..... 439/327
5,516,304 A * 5/1996 Yu ..... 439/326
6,089,905 A * 7/2000 Shimmyo et al. ..... 439/495
6,932,633 B2 * 8/2005 Tsai ..... 439/160
8,444,427 B2 * 5/2013 Hashimoto ..... 439/325
2006/0094277 A1 * 5/2006 Yang et al. ..... 439/328
2008/0207035 A1 8/2008 Jahn
2011/0159718 A1 * 6/2011 Mckee ..... 439/326
2012/0329300 A1 * 12/2012 Ikari ..... 439/153
2013/0224986 A1 * 8/2013 Kitagawa ..... 439/357
2013/0288504 A1 * 10/2013 Sass et al. ..... 439/328

FOREIGN PATENT DOCUMENTS

JP 04218279 8/1992
JP 2001196130 7/2001
JP 2003045529 2/2003
JP 2004273431 9/2004
JP 2009205914 9/2009

OTHER PUBLICATIONS

European Search Report dated May 24, 2013 from corresponding EP Patent Application No. 13156672.1.

* cited by examiner

*Primary Examiner* — Alexander Gilman
(74) *Attorney, Agent, or Firm* — McCormick, Paulding & Huber LLP

(57) ABSTRACT

A cable connector includes an insulator, signal contacts supported in the insulator, wherein the signal contacts come in contact with the cable when the cable is inserted into the insulator, a pair of lock members which are rotatable between a locked position and an unlocked position, and springs supported on the insulator, wherein the springs retain the locked position and allow rotation of the lock members to the unlocked position by elastic deformation of the springs. Each spring includes a base-plate portion supported on the insulator, an elastically deformable portion extending from the base-plate portion, an end-extending portion extending from an end of the elastically deformable portion, and an engaging portion which engages with an associated lock member to integrate the spring with the associated the lock member.

7 Claims, 16 Drawing Sheets

CABLE CONNECTOR

CROSS REFERENCE TO RELATED APPLICATION

The present invention is related to and claims priority of the following co-pending application, namely, Japanese Patent Application No. 2012-041026 filed on Feb. 28, 2012.

FIELD OF THE INVENTION

The present invention relates to a cable connector.

BACKGROUND OF THE INVENTION

A so-called Non-ZIF (Zero Insertion Force) connector is known as an example of an FPC connector in which an insertion force is necessary when a FPC is inserted into the connector.

A Non-ZIF type of FPC connector generally has a structure in which an insertion and retaining of an FPC is carried out in a single action, so that by setting a distance (space) between a pair of contacts (or a distance (space) between a pair of contact pieces provided in a single contact) to be slightly narrower (smaller) than the thickness of the FPC, upon an FPC being inserted into the pair of contacts, a predetermined amount of contacting pressure is applied from the pair of contacts (contact pieces) to the FPC, whereby the FPC and the contacts connect to each other. However, since the inserted FPC is only retained by the contacting pressure of the contacts (contact pieces), if an unintentional strong external force is applied on the FPC in a pulling-out (removal) direction, the FPC can come out of the contacts unexpectedly.

On the other hand, in a ZIF type (in which an insertion resistance between the FPC and the contacts does not occur when the FPC is inserted) of FPC connector having an actuator, since the contacting pressure between the contacts (contact pieces) and the FPC can be increased by operating the actuator in a locking direction, the FPC can be effectively prevented from being unintentionally pulled out from the connector.

Hence, the applicant of the present invention produced the FPC connector disclosed in Japanese Unexamined Patent Application No. 2009-205914.

The FPC connector of the above-mentioned Japanese Unexamined Patent Application No. 2009-205914 is provided with an insulator having an FPC insertion groove into which an FPC having (a pair of) locking portions on the side edges thereof, respectively, is removably insertable; a plurality of contacts supported by the insulator such that the contacts are electrically connected with a circuit board; a single lock member having a pair of lock claws that are disengageably engaged with the pair of locking portions, respectively, the single lock member being supported by the insulator to be rotatable between a locked position, at which the pair of lock claws respectively face the locking portions in the FPC removing/insertion direction, and an unlocked position, at which the pair of lock claws do not face the locking portions in the FPC removing/insertion direction; and a pair of compression coil springs which rotatably bias the lock member toward the locked position.

Upon the end of the FPC being inserted into the insulator, the lock member, which was positioned at the locked position, is rotated to the unlocked position by the lock claws being pushed by the end of the FPC. Furthermore, when the lock claws no longer face the locking portions, the lock member automatically rotates to the locked position by the biasing force of the compression coil springs, and the lock claws become engageable (lockable) with the locking portions.

Accordingly, the FPC connector of the above-mentioned Japanese Unexamined Patent Application No. 2009-205914, while being a type in which a Non-ZIF and an actuator are provided, can connect a FPC with a contact via a single action of inserting the FPC into the insulator.

In the FPC connector of the above-mentioned Japanese Unexamined Patent Application No. 2009-205914, since a compression coil spring is provided on each of the left and right sides of the insulator and the biasing force of each compression coil spring is utilized to rotatably bias the lock member toward the locked position, if the axial length of the compression coil springs is made long (if the compression coil springs are made to deform easily), the lock member can be rotated by a large amount with a small amount of force. However, if the connector is made thinner so as to have a low profile, it becomes difficult to rotate the lock member by a large amount with a small amount of force since the axial length of the compression coil springs becomes shorter (since the compression coil springs become more difficult to deform).

Furthermore, since the FPC insertion grooves and the attachment region of the compression coil springs of the insulator are at different positions from each other in the width direction (arrangement direction of the contacts) of the insulator (FPC), the size of the insulator (and the connector) easily increases in the arrangement direction of the contacts.

Furthermore, since two lock claws are provided on one lock member, if an unintentional external force is applied to the lock member in a locked state, the lock member that was positioned at the locked position unintentionally rotates to the unlocked position, so that both of the lock claws no longer face the respective locking portions.

Therefore, there is room for improvement in regard to the lock retention against unintentional external forces.

SUMMARY OF THE INVENTION

The present invention provides a cable connector in which the entire connector is miniaturized and lock retention against unintentional external forces is improved, while being a type in which a Non-ZIF and an actuator are provided.

According to an aspect of the present invention, a cable connector is provided, including an insulator, into which a thin cable is removably insertable to thereby define a insertion/removal direction, the cable including a pair of engaging portions on each side edge thereof with respect to a lateral direction of the cable; a plurality of signal contacts which are supported in the insulator, which is connected to a circuit board, wherein the signal contacts come in contact with the cable when the cable is inserted into the insulator; a pair of lock members which are independently rotatable, relative to the insulator, between a locked position and an unlocked position, wherein each of the lock members are engageable with an associated the engaging portion at the locked position and are not engageable with the associated the engaging portion at the unlocked position; and a pair of springs which are supported on the insulator, wherein the springs retain the locked position of the lock members, respectively, and allow rotation of the lock members to the unlocked position by elastic deformation of the springs, respectively. Each of the springs includes a base-plate portion which is supported on the insulator, an elastically deformable portion which extends from the base-plate portion in a direction parallel to the insertion/removal direction of the cable, an end-extending portion which extends from an end of the elastically deformable portion in a direction that is different to the extending direction of the elastically deformable portion, and an engaging portion which extends from an end of the end-extending portion in a direction toward the base-plate portion and parallel to the elastically deformable portion, wherein the engaging portion engages with an associated the lock member to integrate the spring with the associated the lock member.

It is desirable for a pair of rotational-shaft support recesses to formed on a surface of the insulator, wherein the lock members are each provided with a rotational shaft which is rotatably fitted in a corresponding the rotational-shaft support recess, and the elastically deformable portions of the springs are provided on the opposite side of the insulator with respect to the lock members, respectively.

It is desirable for each of the lock members to include a narrow-width portion, and a wide portion which is wider than the narrow-width portion in an arrangement direction of the lock members. A cable insertion groove is formed in the insulator, the cable insertion groove being positioned in between a pair of the narrow-width portions when viewed in the insertion/removal direction.

It is desirable for the cable connector to include at least one ground contact, wherein the ground contact comes in contact with the cable when the cable is inserted into the insulator.

It is desirable for the cable connector to include a pair of indicator marks formed on the insulator, wherein, when viewed in the insertion/removal direction of the cable, the indicator marks are covered by the lock members when the lock members are positioned at the locked position, and the indicator marks are exposed by the lock members when the lock members are positioned at the unlocked position.

It is desirable for the cable connector to include a press-receiving portion formed on each of the pair of lock members, wherein the press-receiving portions can be pressed and operated by a pair of pressing portions formed on a single lock-release jig.

It is desirable for each of the press-receiving portions to include a jig recess, wherein the pressing portions are engageable with the jig recesses, respectively.

According to the present invention, since the biaser of the present invention is provided with an elastically deformable portion that extends in a direction parallel to the insertion/removal direction of the cable insulator from the base end supported by the insulator, by increasing the entire length of the elastically deformable portion, the rotational stroke of the lock member can be increased, and the lock member can be rotated by a large amount by a small amount of force that is appropriate for the insertion of an FPC.

Furthermore, since the elastically deformable portion does not easily lose its resilience (since the overall length of the elastically deformable portion can be increased), it is possible to reliably operate the lock member (i.e., to securely hold the cable) even if the lock member is operated repeatedly.

Moreover, since the elastically deformable portion extends in a direction parallel to the insertion/removal direction of the cable, it is possible to narrow (reduce) the width thereof or to reduce the thickness thereof. Accordingly, even if the cable insertion part of the insulator and the attachment region of the elastically deformable portion are at different positions from each other in the width direction (arrangement direction of the contacts) of the insulator, the connector (insulator) is not enlarged in the arrangement direction of the contacts, nor is the connector (insulator) enlarged in the thickness direction of the connector.

Furthermore, since the cable connector is provided with the pair of lock members which rotate mutually independent of each other, even if an unintentional external force is applied against one of the lock members in a locked state, the other lock member stays (remains) at the locked position. Accordingly, since the cable will never be unintentionally removable from the insulator, the cable connector of the present invention has a high lock retention ability against an unintentional external force.

BRIEF DESCRIPTION OF THE DRAWINGS

The present invention will be discussed below in detail with reference to the accompanying drawings, in which.

BRIEF DESCRIPTION OF THE PREFERRED EMBODIMENTS

Figure 1:
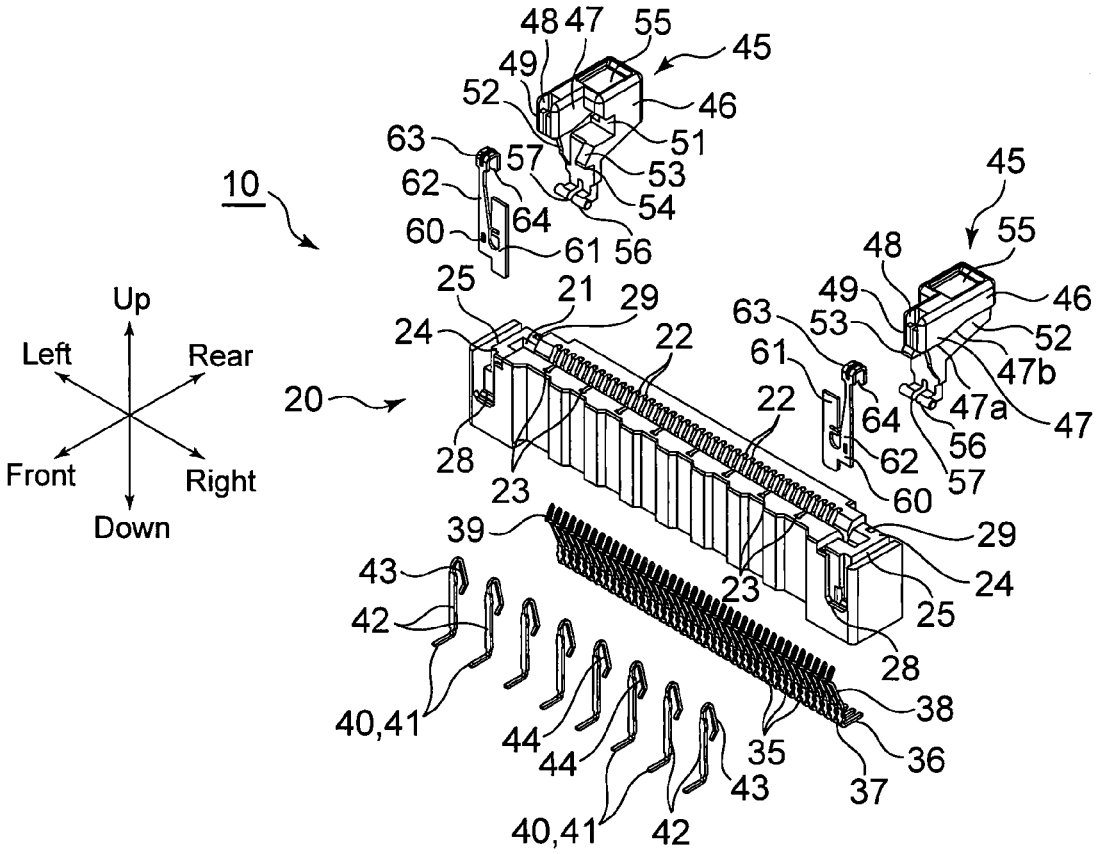
FIG. 1 is an exploded perspective view of a FPC connector, as viewed in an oblique direction from the front upper side thereof, according to a first embodiment of the present invention.
Figure 2:
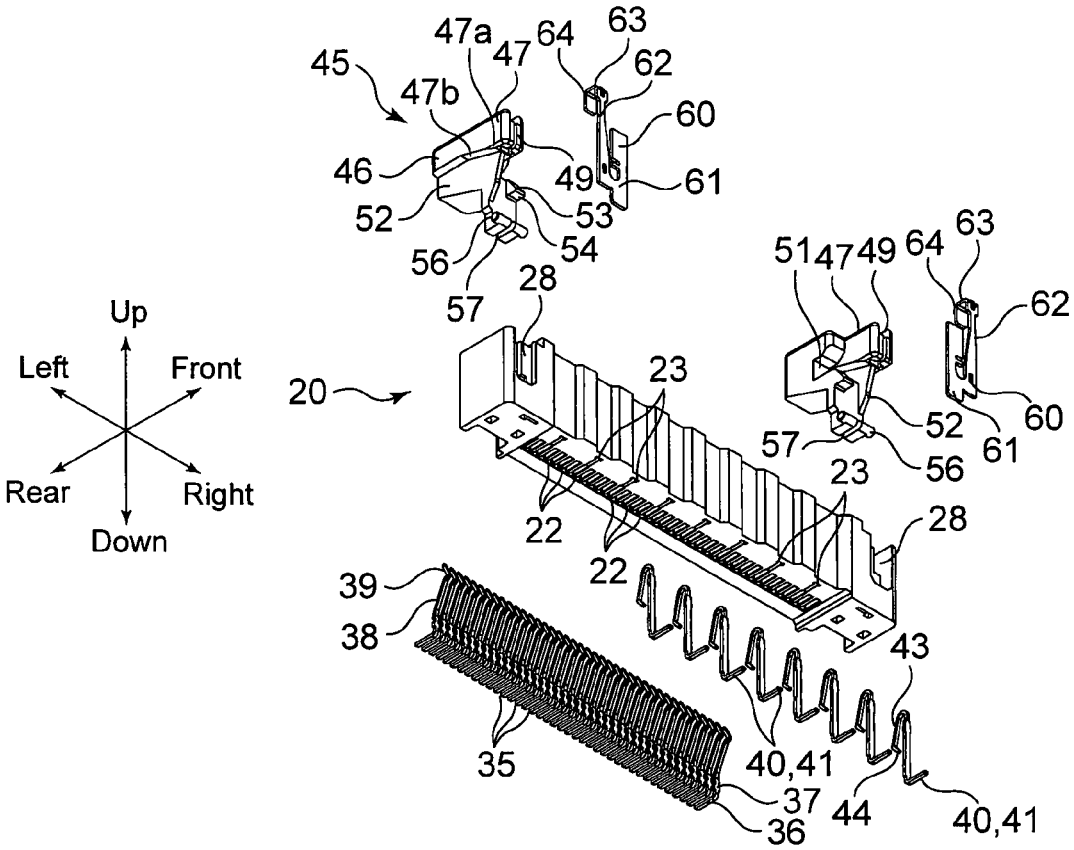
FIG. 2 is an exploded perspective view of the FPC connector, as viewed in an oblique direction from the front lower side thereof.

A first embodiment of the present invention will be hereinafter discussed with reference to FIGS. 1 through 21. Note that the "upward", "downward", "left", "right", "forward" and "rearward" directions are based on the directions of the arrows that are indicated in the drawings.

The cable connector of the first embodiment is a so-called "straight" (ST) FPC connector 10 in which a cable (FPC 70) is inserted in a direction orthogonal to a circuit board CB, onto which the connector is installed; e.g., the connector can be installed onto a circuit board CB (see FIGS. 3, 4, 8, 12, 15 and 19) which is provided inside a car navigation system or an audio device installed in an automobile (vehicle), or office automation equipment (e.g., a photocopier machine, or a multifunction printer provided with photocopying and facsimile functions, etc.). The FPC connector 10 is provided with, as major components thereof, an insulator 20, signal contacts 35, ground contacts 40, a pair of lock members 45, and a pair of lock-member biasing springs 60.

The insulator 20, which is bilaterally symmetrical in shape, is formed out of a compound resin material, having insulation properties and heat-resistivity, via injection molding. As shown in the drawings, the insulator 20 is provided with an FPC insertion groove (cable insertion groove) 21 which is formed in the upper surface of the insulator 20, except left and right side portions thereof, and extends downwardly therefrom. The rear surface of the FPC insertion groove 21 is provided with signal-contact insertion grooves 22 and the front surface of the FPC insertion groove 21 is provided with ground-contact insertion grooves 23. The lower ends of a total of forty (40) of the signal-contact insertion grooves 22 formed on the rear surface of the FPC insertion groove 21 are open at the lower surface of the insulator 20, and the lower ends of a total of eight (8) of the ground-contact insertion grooves 23 formed on the front surface of the FPC insertion groove 21 are open at the lower surface of the insulator 20.

The upper surfaces of the insulator 20 at the left and right end portions thereof form flat-surfaced lock-member mounting surfaces 24, and a guide-rib insertion groove 25 which extends in the forward/rearward direction, in a plan view, is formed downwards in each lock-member mounting surface 24. The rear surfaces of the left and right side portions of the insulator 20 are provided with left and right lock-member receiving recesses 26, respectively, the upper portions thereof being communicably connected with rear portions of the left and right associated guide-rib insertion grooves 25, respectively, and the inward side portions of the left and right lock-member receiving recesses 26 (the right side portion of the left lock-member receiving recess 26 and the left side portion of the right lock-member receiving recess 26) are communicably connected with the left and right portions of the FPC insertion groove 21, respectively (see FIG. 11). Furthermore, left and right rotational-shaft support recesses 27 are formed, in the forward direction, in the insulator 20 in the vicinity of the lower ends of the left and right lock-member receiving recesses 26, respectively. On the other hand, left and right spring support grooves 28 are formed on the front surfaces of the left and right side portions of the insulator 20, respectively, and the upper portions of the left and right spring support grooves 28 are communicably connected with the front portions of the left and right guide-rib insertion grooves 25.

Furthermore, a pair of left and right indicator marks 29 are formed on the left and right upper rear-edge portions of the insulator 20, respectively.

A total of forty (40) signal contacts 35 are formed with a progressive die (in a stamping process) into the shape shown in the drawings using a thin plate of copper alloy having spring elasticity (e.g., phosphor bronze, beryllium copper or titanium copper) or Corson copper alloy having spring elasticity. The surfaces of the signal contacts 35 are first plated with nickel as a base plate, and thereafter are gold plated, so that each signal contact 35 is electrically conductive. As shown in the drawings, each signal contact 35 is provided with a tail piece 36 extending in the forward/rearward direction, a press-fitting piece 37 extending upwards from the front end of the tail piece 36, and an elastically deformable piece 38 extending upward from the upper end of the press-fitting piece 37 and inclined in a forward direction; a bent contact projection 39 is formed at the vicinity of the upper end of the elastically deformable piece 38.

Each signal contact 35 is fixedly fitted into a corresponding signal-contact insertion groove 22 by inserting the upper end of the elastically deformable piece 38 from the lower opening of the corresponding signal-contact insertion groove 22 and by press-fitting the press-fitting piece 37 into the lower portion of the corresponding signal-contact insertion groove 22. The elastically deformable piece 38 of each signal contact 35 is elastically deformable in the forward/rearward direction within the corresponding signal-contact insertion groove 22, and the contact projection 39 protrudes into the FPC insertion groove 21 when the elastically deformable piece 38 is in a free state (see FIG. 10).

A total of eight (8) ground contacts 40, which have elasticity and are formed from the same material as that of the signal contacts 35, are each provided with a tail piece 41 extending in the forward/rearward direction, a press-fitting piece 42 extending upwards from the rear end of the tail piece 41, and an elastically deformable piece 43 that extends downwardly from the upper end of the press-fitting piece 42 while inclining rearwardly; a bent contact projection 44 is formed at the vicinity of the lower end of the elastically deformable piece 43.

Each ground contact 40 is fixedly fitted into a corresponding ground-contact insertion grooves 23 by inserting the press-fitting piece 42 and the upper end portion of the elastically deformable piece 43 from the lower opening of the corresponding ground-contact insertion groove 23 and by press-fitting the press-fitting piece 42 into the lower portion of the corresponding ground-contact insertion groove 23. The elastically deformable piece 43 of each ground contact 40 is elastically deformable in the forward/rearward direction within the corresponding ground-contact insertion groove 23, and the contact projection 44 protrudes into the FPC insertion groove 21 when the ground contact 40 is in a free state (see FIG. 10).

The pair of left and right lock members 45 are injection-molded (integrally molded) from a heat-resistant compound resin. The left and right lock members 45 are mutually bilaterally symmetrical. The rear half of the upper portion of each lock member 45 is an operational portion (wide portion) 46, and a rotation-restricting portion (narrow-width portion) 47 having smaller dimensions in the leftward/rightward direction than those of the operational portion 46 project in a forward direction from the outer portion of the front surface of the operational portion 46 (the left side portion of the left operational portion 46 and the right side portion of the right side portion of the right operational portion 46). The undersurface of each of the rotation-restricting portions 47 is provided with a flat-surfaced locked-position restricting surface 47*a*, and a flat-surfaced unlocked-position restricting surface 47*b* which is inclined with respect to the lock-position restricting surface 47*a*. The front portion of each rotation-restricting portions 47 is provided with a spring-engagement hole 48 which extends through the corresponding rotation-restricting portion 47 in the upward/downward direction, and an engaging portion 49 which closes up the front side of the corresponding spring-engagement hole 48 is formed on the front end portion of the corresponding rotation-restricting portion 47. A rearwardly facing escape recess 51 is provided on an inner side portion from the front side of the operational portion 46 (on the right side of the left operational portion 46 and on the left side of the right operational portion 46), and a plate-like guide rib 52 that is orthogonal with respect to a horizontal direction is provided on the undersurface of the operational portion 46 and the rotation-restricting portion 47 and projects downwardly therefrom. A lock claw 53, which projects in the forward direction, is provided on a front side of a substantially central portion of each lock member 45, with respect to the upward/downward direction. As shown in the drawings, the undersurface of each lock claw 53 constitutes a lock surface 54, which is a flat surface lying on a plane that is orthogonal to the upward/downward direction, and the upper surface of each lock claw 53 is an inclined surface with respect to the corresponding lock surface 54. Furthermore, a jig recess (press-receiving portion) 55 having a rectangular shape in a plan view is formed in the upper surface of each operational portion 46, and a substantially cylindrical shaped rotational shaft 56 extending the leftward/rightward direction is formed at the lower end of each lock member 45.

Figure 7:
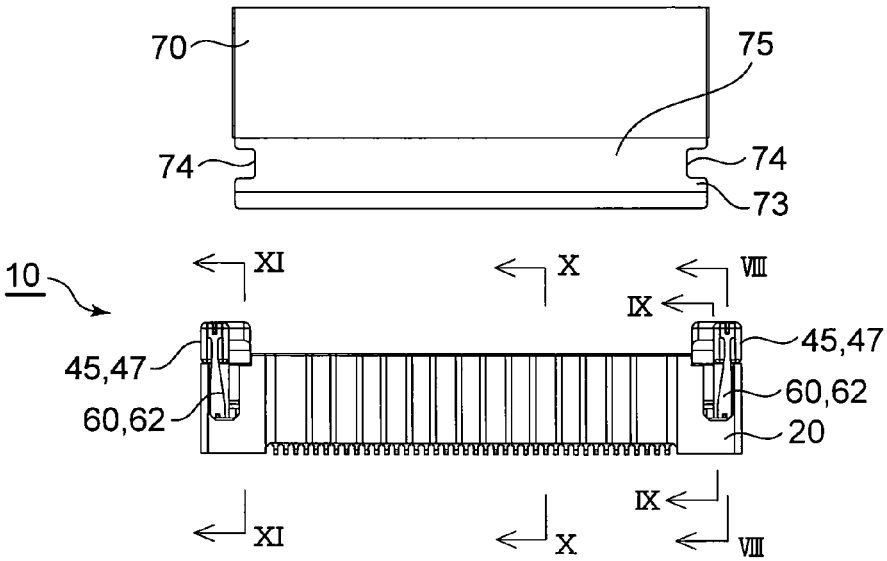
FIG. 7 is a front elevational view of the FPC connector, showing the lock members in the locked position.
Figure 8:
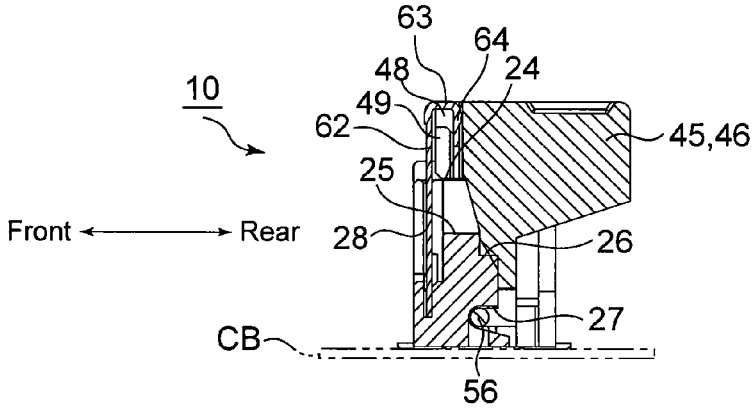
FIG. 8 is a sectional view taken along the VIII-VIII line shown in FIG. 7, viewed in the direction of the appended arrows.
Figure 9:
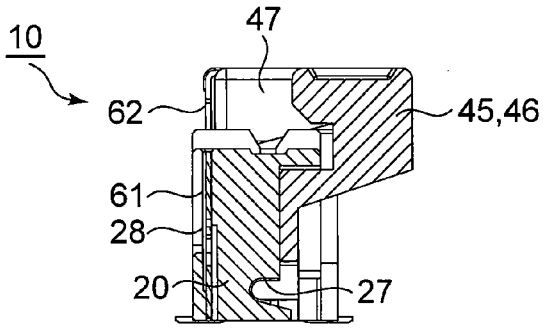
FIG. 9 is a sectional view taken along the IX-IX line shown in FIG. 7, viewed in the direction of the appended arrows.
Figure 10:
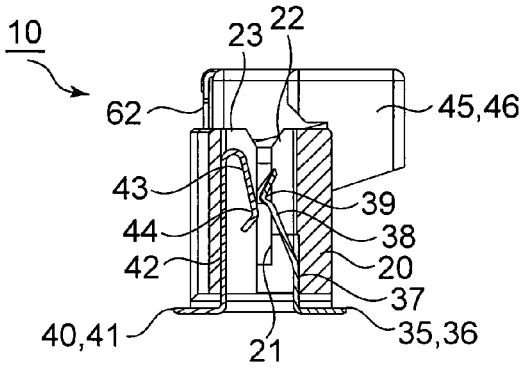
FIG. 10 is a sectional view taken along the X-X line shown in FIG. 7, viewed in the direction of the appended arrows.
Figure 11:
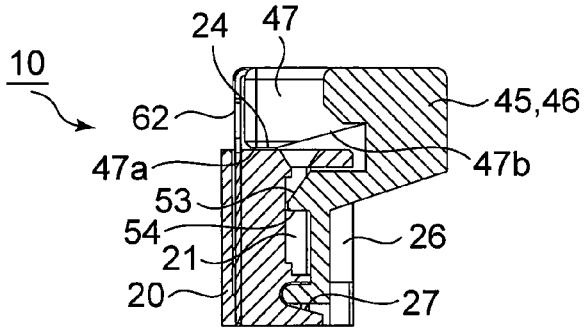
FIG. 11 is a sectional view taken along the XI-XI line shown in FIG. 7, viewed in the direction of the appended arrows.

The left and right lock members 45 are mounted to the insulator 20 so as to be rotatable about the rotational axes of the rotational shafts 56, respectively, by engaging each rotational shaft 56 with a corresponding rotational-shaft support recess 27 from the rear side, and by fitting each guide rib 52 into a corresponding guide-rib insertion groove 25 so as to be relatively slidable therewith (see FIGS. 8 and 9, etc.). As shown in the drawings, a slit 57 (to make it easier for the left and right sides of the rotational shaft 56 to flex) is formed in a front central portion of each rotational shaft 56, and a pair of left and right retainer projections (not shown) are formed on the inner surfaces of the left and right rotational-shaft support recesses 27, respectively. Accordingly, when the rotational shaft 56 of each lock member 45 is inserted into a corresponding rotational-shaft support recess 27 from the rear side and the left and right side portions of the rotational shaft 56 contact a corresponding retainer projection, the left and right side portions of the rotational shaft 56 flex while riding over the corresponding retainer projection and the rotational shaft 56 moves into inner end of the rotational-shaft support recess 27. Hence, when the rotational shaft 56 returns to a free state by the left and right side portions of the rotational shaft 56 riding over the above-mentioned corresponding retainer projection, the worker/technician, etc., can feel a tactile 'click'. Furthermore, upon the rotational shaft 56 being moved into inner end of the rotational-shaft support recess 27, the rotational shaft 56 is prevented from coming out of the rear end opening of the rotational-shaft support recesses 27 by the above-mentioned retainer projection. The left and right lock members 45 are rotatable in a mutually independent manner, and are rotatable between the locked position shown in FIGS. 3 through 14, FIGS. 19 through 21, and the unlocked position shown in FIGS. 15 through 18. As shown in FIGS. 3 through 14, and FIGS. 19 through 21, when each lock member 45 is positioned at the locked position, the lock-position restricting surface 47*a* of the rotation-restricting portions 47 comes into surface contact with the corresponding lock-member mounting surfaces 24, and the (rear) upper-ends of the left and right side portions of the insulator 20 are positioned in the escape recesses 51, respectively. Furthermore, each lock claw 53 enters into the end portion of the FPC insertion groove 21 through the inner portion of the corresponding lock-member receiving recess 26 (see FIGS. 11, 14 and 21), and the lower half of the front surface of each lock member 45 contacts the corresponding lock-member receiving recess 26 (see FIGS. 8 and 9). Furthermore, when the lock members 45 are positioned at the locked position, since the left and right indicator marks 29 are covered by the lock members 45 (operational portions 46), respectively, when the FPC connector 10 is viewed in a plan view, as shown in FIG. 5, a worker/technician, etc., can visually confirm that the lock members 45 are positioned at the locked position.

Figure 15:
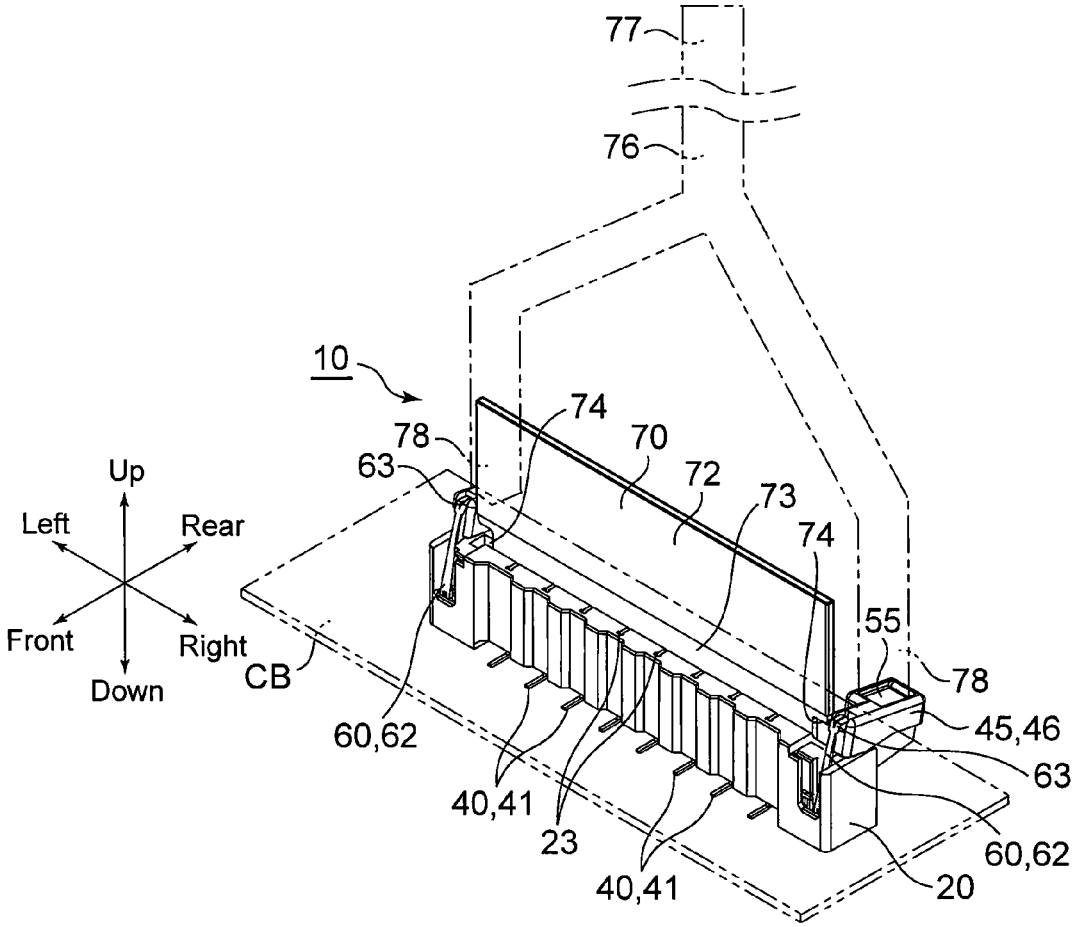
FIG. 15 is a perspective view similar to that of FIG. 3, of the FPC connector showing the lock members, which were positioned in the locked position, moved to the unlocked position by the insertion of the end of the FPC into the insulator or by the removal of the end of the FPC from the insulator.
Figure 16:
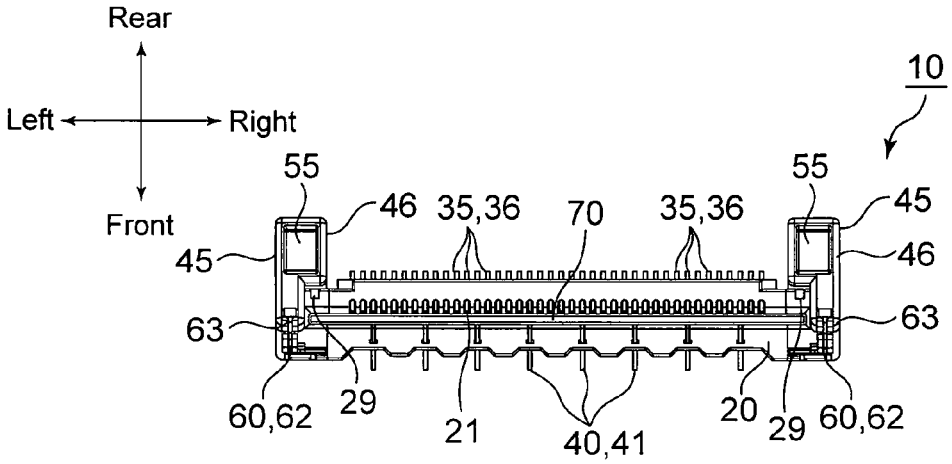
FIG. 16 is a plan view of the FPC connector in the same state as that shown in FIG. 15.
Figure 17:
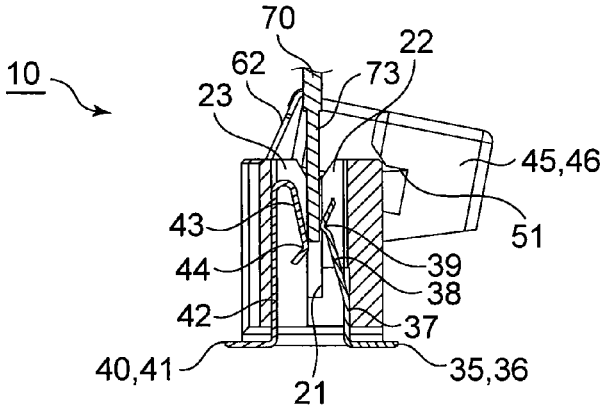
FIG. 17 is a sectional view similar to that of FIG. 10 in the state shown in FIG. 15.
Figure 18:
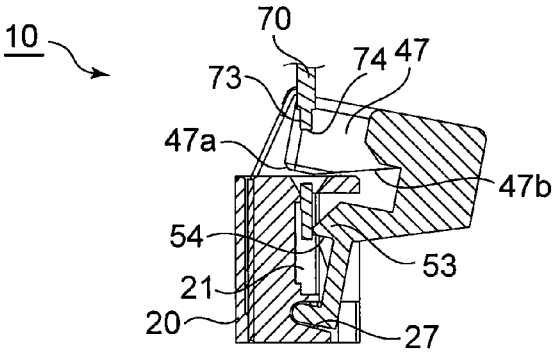
FIG. 18 is a sectional view similar to that of FIG. 11 in the state shown in FIG. 15.

On the other hand, as shown in FIGS. 15 through 18, when the lock members 45 are positioned at the unlocked position, the unlocked-position restricting surfaces 47*b* (and the lock-position restricting surfaces 47*a*) of the rotation-restricting portions 47 are moved upwardly from the corresponding lock-member mounting surfaces 24, respectively, and the escape recesses 51 are moved rearwardly away from (the rear of) the upper end portions of the left and right side portions of the insulator 20, respectively. Note that the lock members 45 are rotatable further downward from the position shown in FIGS. 15 through 18; specifically, the lock members 45 are rotatable down to the position (not shown) at which the unlocked-position restricting surface 47*b* come into contact with lock-member mounting surfaces 24, respectively. In other words, the unlocked position of the lock members 45 is not limited to a specified single position (point), rather the unlocked position has a predetermined range of positions. Furthermore, when the lock members 45 are rotated to the unlocked position, the lock claws 53 move rearwardly from (toward the lock-member receiving recesses 26) the end portion of the FPC insertion groove 21 (if the lock members 45 are rotated to the unlocked position shown in FIGS. 15 through 18, part of each lock claw 53 remains in the end portion of the FPC insertion groove 21, and if the lock members 45 are rotated to the unlocked position at which the unlocked-position restricting surfaces 47*b* respectively come in contact with the lock-member mounting surfaces 24, the entirety of each claw 53 is removed from the end portion of the FPC insertion groove 21), and the lower half portions of the front surfaces of the lock members 45 respectively move rearwardly away from the corresponding lock-member receiving recesses 26, respectively. Furthermore, when the lock members 45 are positioned at the unlocked position, since the lock members 45 (operational portion 46) expose the left and right indicator marks 29, respectively, when the FPC connector 10 is viewed in a plan view, as shown in FIG. 16, the worker/technician, etc., can visually confirm that the lock members 45 are positioned at the unlocked position.

The pair of left and right lock-member biasing springs 60, which have elasticity, are formed from a metal (copper alloy or stainless) plate, and are each provided with a flat base-plate portion 61, an elastically deformable portion 62 which extends upwardly from the vicinity of the lower end of a side edge portion of the base-plate portion 61 and lies in the same plane as that of the base-plate portion 61, an end-extending portion 63 which extends rearwardly from the upper end of the elastically deformable portion 62, and an engaging portion 64 extending downwardly from the end of the end-extending portion 63 and parallel to (or substantially parallel to) the elastically deformable portion 62.

Each of the left and right lock-member biasing springs 60 is attached to the insulator 20 by fitting each base-plate portion 61 and each elastically deformable portion 62 into the respective left and right spring support grooves 28 from above, and by fixing the lower end of each elastically deformable portion 62 and each base-plate portion 61 to the left and right spring support grooves 28, respectively, in a state in which the lock members 45 are positioned at the locked position with respect to the insulator 20. Upon the lock-member biasing springs 60 being attached to the insulator 20 (left and right spring support grooves 28), each engaging portion 64 enters into the associated spring-engagement hole 48 from above, so that the front surface of each engaging portion 64 comes in surface contact with the corresponding rear surface of the engaging portion 49 (see FIG. 8). Accordingly, when the lock members 45 are positioned at the locked position, the elastically deformable portion 62 of each lock-member biasing spring 60 is in a free state, extending parallel to (or substantially parallel) the upward/downward direction (insertion/removal direction of the FPC 70 into/from the FPC insertion groove 21), so that the lock members 45 are maintained at the locked position by the engaging portions 64 of the lock-member biasing springs 60.

The FPC connector 10 having the above-described structure is installed onto the upper surface of the circuit board CB by the FPC connector 10 being placed onto the upper surface of the circuit board CB, which is rectangular in shape in a plan view, and the tail pieces 36 of the signal contacts 35 are soldered to the circuit pattern on the circuit board CB, and the tail pieces 41 of the ground contacts 40 are soldered to the ground pattern of the circuit board CB.

Figure 3:
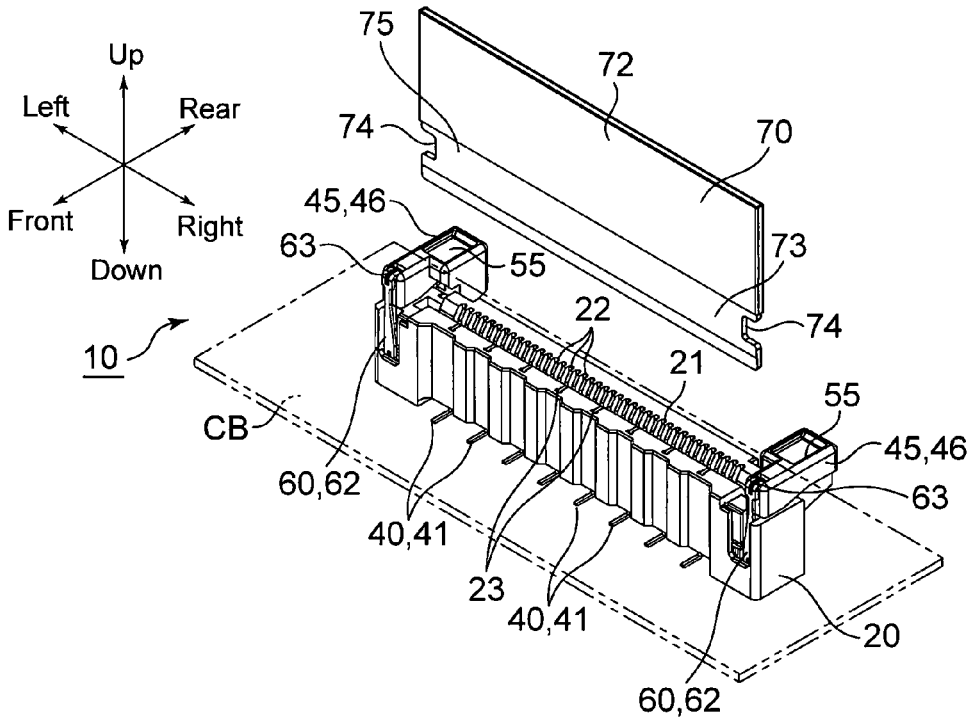
FIG. 3 is a perspective view of the FPC connector, as viewed from the front thereof.
Figure 4:
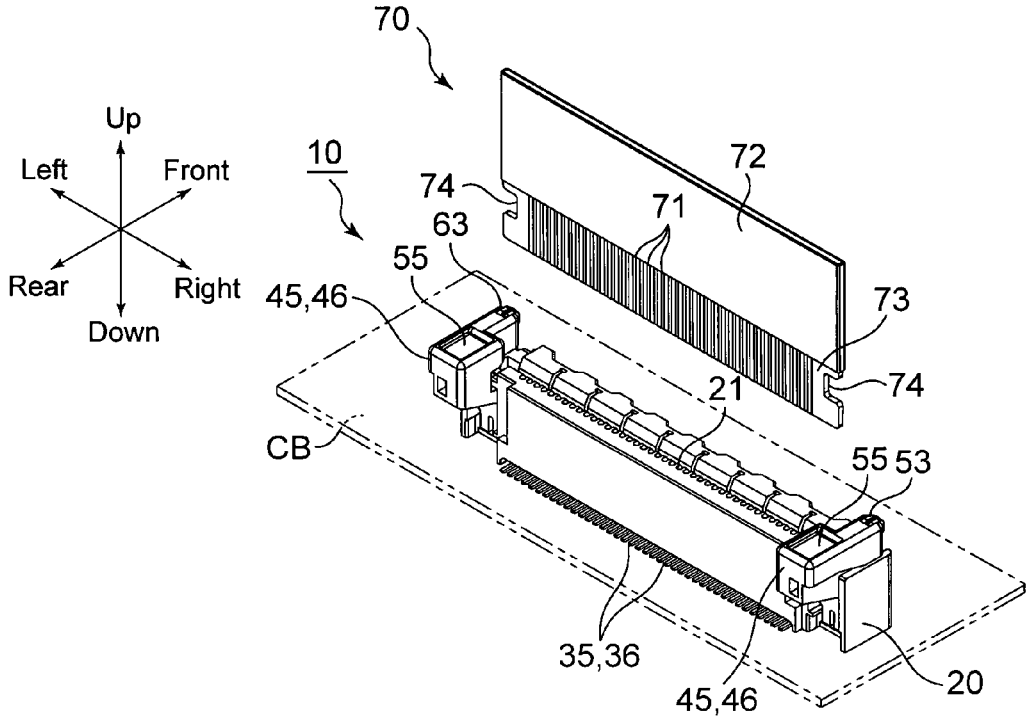
FIG. 4 is a perspective view of the FPC connector, as viewed from the rear thereof.
Figure 5:
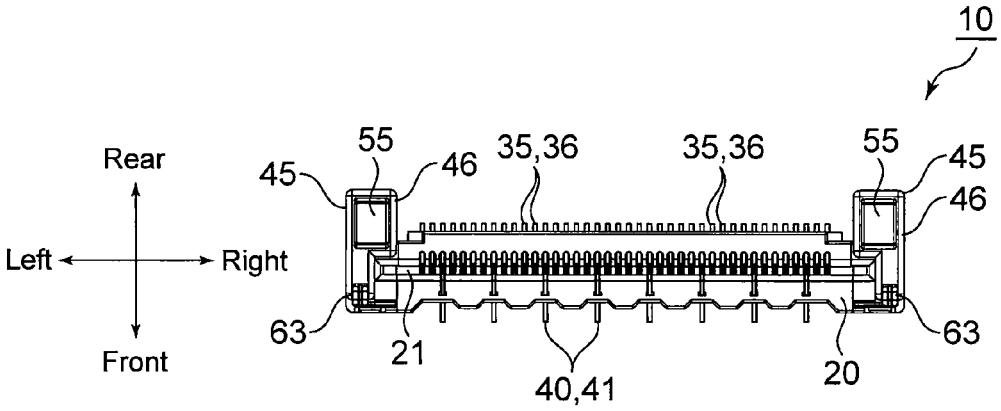
FIG. 5 is a plan view of the FPC connector.
Figure 6:
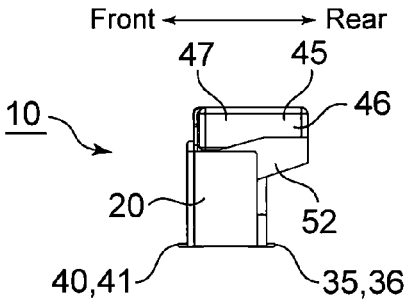
FIG. 6 is a side elevational view of the FPC connector.

Hereinafter, the connection and connection-release operations of an FPC (Flexible Printed Circuit) 70 (only one end and the close vicinity thereof is shown in FIGS. 3, 4 and 7, etc.), which is a long thin cable, to the FPC connector 10, and the connection and connection-release operations of the FPC connector 10 will be discussed.

As shown in the drawings, the FPC 70 has a laminated structure formed from a plurality of layers of thin film that are mutually adhered to each other, and is provided with a total of forty (40) circuit patterns 71 which extend in straight lines in a longitudinal direction of the FPC 70; an insulation cover layer 72 which covers both sides of the FPC 70 except the circuit patterns 71 at each end thereof; and an edge-reinforcement member 73 which is formed on each edge of the FPC 70, with respect to the longitudinal direction thereof, wherein one surface of the edge-reinforcement member 73 (the rear surface in FIG. 4) is integral with each edge of the circuit patterns 71 and is harder (has a greater rigidity) than the remainder of the FPC 70. Furthermore, the left and right side portions of the edge-reinforcement member 73 is provided with left and right engagement recesses 74, respectively (the end portions adjacent to the engagement recesses 74 in the longitudinal direction of the FPC 70 define "locking portions"), and the entire (or substantially the entire) front surface of the edge-reinforcement member 73 forms a ground terminal 75. The distance (dimensions) in the forward/rearward direction between the contact projections 39 of the elastically deformable pieces 38 (of the signal contacts 35) in a free state and the front surface of the FPC insertion groove 21 is smaller than the thickness of the FPC 70.

Figure 12:
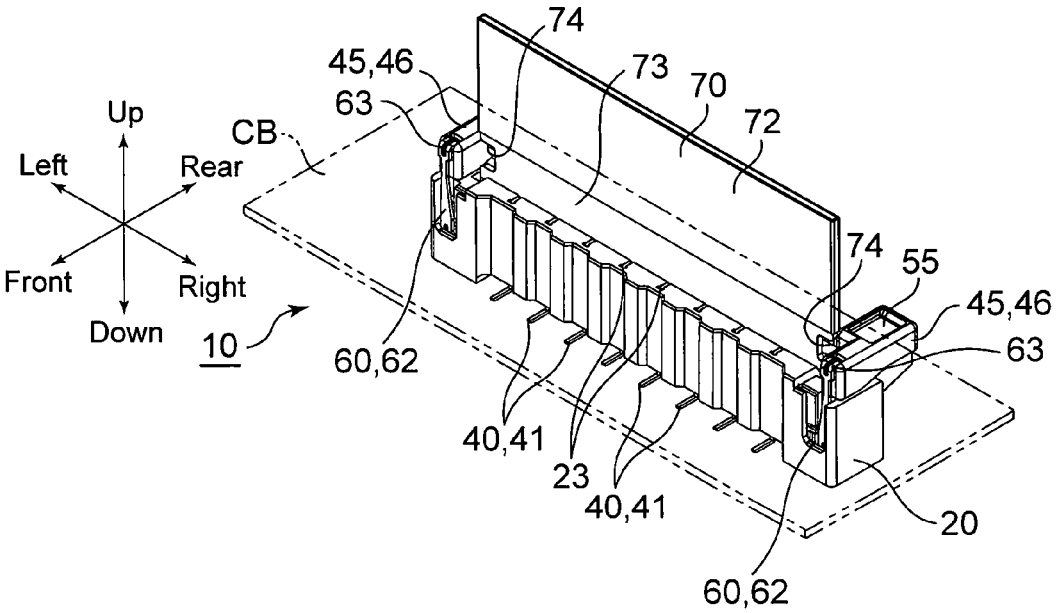
FIG. 12 is a perspective view similar to that of FIG. 3, showing an end of the FPC in contact with contact-projections of the contacts and the lock claws of the lock members.
Figure 13:
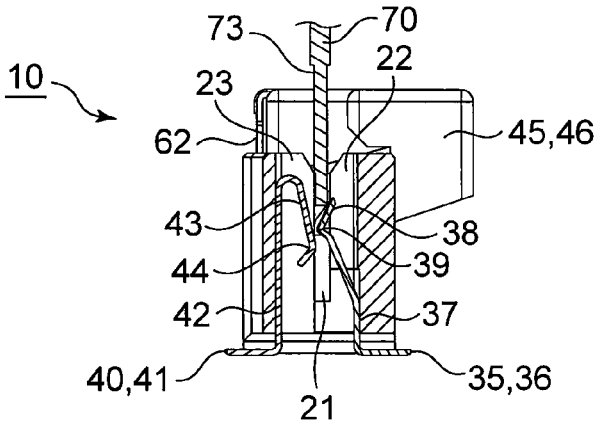
FIG. 13 is a sectional view similar to that of FIG. 10 in the state shown in FIG. 12.
Figure 14:
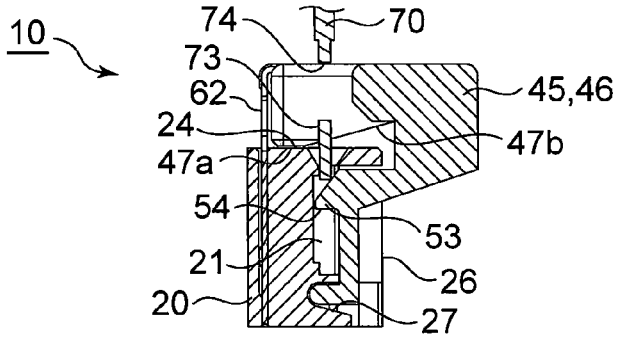
FIG. 14 is a sectional view similar to that of FIG. 11 in the state shown in FIG. 12.

As shown in FIGS. 3 and 4, etc., the edge portion of the FPC 70 is brought close to the FPC connector 10 from above, and as shown in FIGS. 12 through 14, when the FPC 70 is inserted into the FPC insertion groove 21 of the insulator 20, the end-edge surface of the FPC 70 (edge-reinforcement member 73) substantially simultaneously contacts the elastically deformable pieces 38 (directly above the contact projections 39) of the signal contacts 35 and the inclined surfaces of the lock claws 53 of the lock members 45 (see FIGS. 13 and 14). Accordingly, since the FPC 70 (except the left and right side portions thereof) contacts the signal contacts 35 simultaneously with the left and right side portions of the FPC 70 contacting the left and right lock claws 53, the FPC 70 can be inserted into the FPC insertion groove 21 with a stable orientation while preventing the FPC 70 from flexing (in the forward/rearward direction). Accordingly, it is difficult for variations in the insertion force of the FPC 70 into the FPC insertion groove 21 to occur. Furthermore, since the orientation of the FPC 70 is stable, buckling of the signal contacts 35 can be prevented, and deformation of the signal contacts 35 in an unintended direction (e.g., deformation in the leftward/rightward direction) upon insertion of the FPC 70 can be prevented.

Upon the FPC 70 being moved further downward, as shown in FIGS. 15 through 18, the lower edge portion of the edge-reinforcement member 73 enters deeper inside (toward the bottom end of) the FPC insertion groove 21 while elastically deforming the elastically deformable pieces 38 and the elastically deformable pieces 43 (while expanding the gap (distance) in the forward/rearward direction formed between the contact projections 39 and the contact projections 44). Furthermore, since the left and right side edges of the edge-reinforcement member 73 press against the upper surfaces (inclined surfaces) of the left and right lock claws 53 of the left and right lock members 45, respectively, the lock members 45 rotate to the unlocked position shown in FIGS. 15 through 18 while elastically deforming in the rear direction the elastically deformable portions 62 of the lock-member biasing springs 60, respectively.

Figure 19:
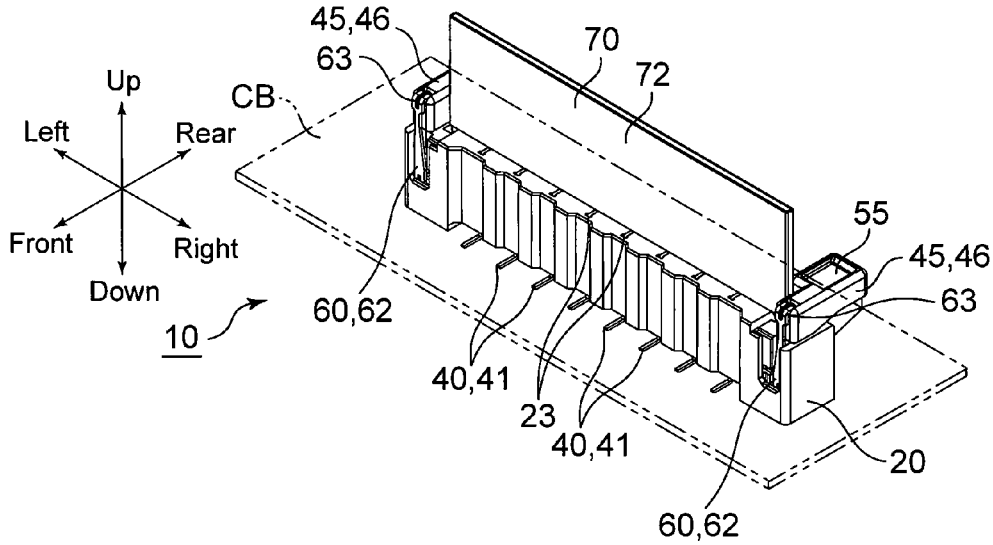
FIG. 19 is a perspective view similar to that of FIG. 3, of the end of the FPC fully inserted into the insulator.
Figure 20:
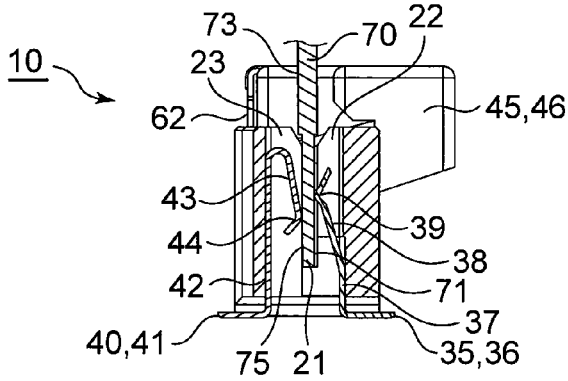
FIG. 20 is a sectional view similar to that of FIG. 10 in the state shown in FIG. 19.
Figure 21:
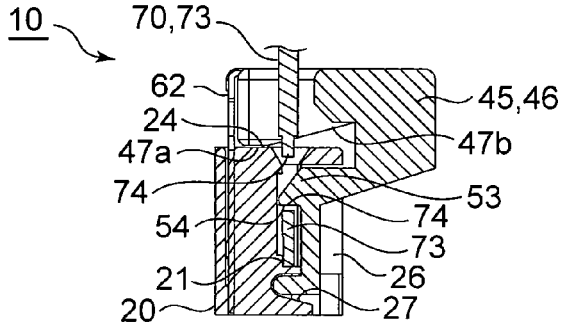
FIG. 21 is a sectional view similar to that of FIG. 11 in the state shown in FIG. 19.

Upon further downward movement of the FPC 70, as shown in FIGS. 19 through 21, the edge-reinforcement member 73 enters deeper inside (bottom end of) the FPC insertion groove 21. Furthermore, since the lower end portion of the edge-reinforcement member 73 rides over the left and right lock claws 53, and the lock members 45 are rotatably returned to the locked position by the elastically deformable portions 62 of the lock-member biasing springs 60 elastically returning to its free state when the left and right engagement recesses 74 and the left and right lock claws 53 face each other in the forward/rearward direction, so that the left and right lock claws 53 enter into the corresponding engagement recesses 74, respectively (see FIG. 21). Accordingly, even if an unintentional upward external force were to be applied against the FPC 70, since movement of the FPC 70 in an upward direction is prevented by the lower surfaces of the engagement recesses 74 coming in contact with (engaging with) the lock surfaces 54 of the lock claws 53, respectively, the FPC 70 does not come out upwardly from the FPC connector 10. Furthermore, when the lock members 45 rotatably return to the locked position by the elastic force of the elastically deformable portions 62 of the lock-member biasing springs 60, since a worker/technician, etc., can feel a strong tactile click, the worker/technician, etc., can not only visually confirm that the indicator marks 29 are covered by the lock members 45 (operational portions 46), but also can reliably discern that the lock members 45 have returned to the locked position by the tactile feel in his/her hand.

Furthermore, since the circuit patterns 71 of the FPC 70 are in contact with the contact projections 39 of the signal contacts 35, electrical conduction between the FPC 70 and the circuit board CB can be carried out via the signal contacts 35. Furthermore, the contact projections 44 of the ground contacts 40 come in contact with the ground terminals 75.

Hence, the FPC 70 and the signal contacts 35 can be reliably connected by a single action of inserting the FPC 70 into the insulator 20.

As shown in FIGS. 19 through 21, in the case where one wants to pull out the FPC 70 from the FPC connector 10 that is in a locked state, a lock-release jig 76 shown in FIG. 15 is used to operate the left and right lock members 45.

As shown in FIG. 15, the lock-release jig 76 is provided with a rod-shaped grip portion 77, and a bifurcated portion which is bifurcated at the lower end of the 77. A fitting portion 78 (pressing portion) is formed at each lower end of the bifurcated portion.

When a worker/technician fits the two fitting portions 78 into the jig recesses 55 of the left and right lock members 45, respectively, while gripping the grip portion 77 by hand and simply moves the lock-release jig 76 downwards from that position, the left and right lock members 45 are simultaneously rotated down to the unlocked position (see FIGS. 15 through 18). Accordingly, since the left and right lock claws 53 are released rearwardly from the corresponding engagement recesses 74, the FPC 70 can be pulled upwards out from the FPC insertion groove 21. After pulling out the FPC 70 from the FPC connector 10, if the pair of fitting portions 78 are removed away from the left and right jig recesses 55 (of the lock members 45) by moving the lock-release jig 76 upwards, since the lock members 45 rotatably return to the locked position by the biasing force of the lock-member biasing springs 60, the FPC connector 10 automatically returns to the locked state shown in FIGS. 3 through 8.

As described above, since the FPC connector 10 can be provided inside, e.g., a car navigation system, an audio device or office automation equipment, it is generally not easy for a worker/technician to simultaneously operate the pair of lock members 45 by hand. However, if the lock-release jig 76 is utilized, the pair of lock members 45 of the FPC connector 10 provided inside such devices can be easily unlocked.

Furthermore, in the FPC connector 10 according to the illustrated embodiment, when in a locked state as shown in FIGS. 19 through 21, even if an unintentional external force is applied to one of the lock members 45 so that this lock members 45 is unintentionally rotated to the unlocked position, since the other lock member 45 remains at the locked position, the FPC 70 does not upwardly come out of the FPC insertion groove 21. Accordingly, the FPC connector 10 has a high lock-retention ability against unintentional external forces.

Furthermore, the left and right lock-member biasing springs 60 are each provided with the elastically deformable portion 62 that extends upwardly from the base-plate portion 61, and the engaging portion 64, which extends downwardly from the end-extending portion 63 which extends rearwardly from the upper end of the elastically deformable portion 62, is engaged with the spring-engagement hole 48 (engaging portion 49). Therefore, it is possible to increase the rotational stroke of each lock member 45 by increasing the entire length of the elastically deformable portion 62 to thereby increase the elastic deforming amount of the elastically deformable portion 62 in the forward/rearward direction. Furthermore, the lock members 45 can be rotated by a large amount by a small force that is appropriate for insertion of the FPC 70.

In addition, since the entire length of the elastically deformable portion 62 can be increased, is possible to make it difficult for the elastically deformable portion 62 to lose its resilience. Accordingly, even if the lock members 45 are operated repeatedly, it is possible to reliably operate the lock members 45 (i.e., to reliably and securely hold the FPC 70 in the FPC insertion groove 21).

Moreover, since the elastically deformable portions 62 of the lock-member biasing springs 60 extend in a direction parallel to the insertion/removal direction of the FPC 70, it is possible to reduce the width of the elastically deformable portion 62 in the leftward/rightward direction and to reduce the thickness thereof (in the forward/rearward direction). Accordingly, even though the elastically deformable portions 62 are provided on the insulator 20 at the outer sides of the FPC insertion groove 21, the FPC connector 10 (insulator 20) is prevented from getting larger in the lateral arrangement direction of the signal contacts 35. Furthermore, since the thickness of the elastically deformable portions 62 (dimensions in the forward/rearward direction) is small, the thickness (dimensions in the forward/rearward direction) of the FPC connector 10 does not easily increase.

Furthermore, since the rotation-restricting portions 47, which have narrow-width dimensions in the leftward/rightward direction, are provided between the left-end surface of the insulator 20 and the left end portion of the FPC insertion groove 21, and between the right-end surface of the insulator 20 and the right end portion of the FPC insertion groove 21, the left and right lock members 45 do not cause the width of the FPC connector 10 to increase in the leftward/rightward direction.

Whereas, since the operational portions 46 that are positioned further rearward than the FPC insertion groove 21 have wider dimensions in the leftward/rightward direction than those of the rotation-restricting portions 47, it is easy to carry out the unlocking operation.

Furthermore, it is possible to attach the lock members 45 and the lock-member biasing springs 60 to the insulator 20 by positioning the lock members 45 at the locked position, by engaging from the rear side the rotational shafts 56 and the guide ribs 52 with the rotational-shaft support recesses 27 and the guide-rib insertion grooves 25, respectively, engaging from above the lock-member biasing springs 60 (the base-plate portion 61 and the elastically deformable portions 62) with the left and right spring support grooves 28, respectively, from the opposite side of the insulator 20 with respect to the lock members 45, and inserting from above the engaging portions 64 into the spring-engagement holes 48 (to engage with the engaging portions 49). Accordingly, the procedure for assembling the lock members 45 and the lock-member biasing springs 60 onto the insulator 20 is easy.

In other words, if grooves were to be formed on the rear surface of the insulator 20 at positions in the close vicinity of the lock members 45, and the lock-member biasing springs 60 were to be attached to these grooves so that the lock-member biasing springs 60 are engaged with the lock members 45, the lock members 45 and the lock-member biasing springs 60 would be close to each other. Accordingly, since the lock members 45 and the lock-member biasing springs 60 (other than the engaging portions 64) would easily interfere with each other when the lock members 45 and the lock-member biasing springs 60 are being assembled onto the insulator 20, it would be difficult to assemble the lock members 45 and the lock-member biasing springs 60 onto the insulator 20.

Figure 22:
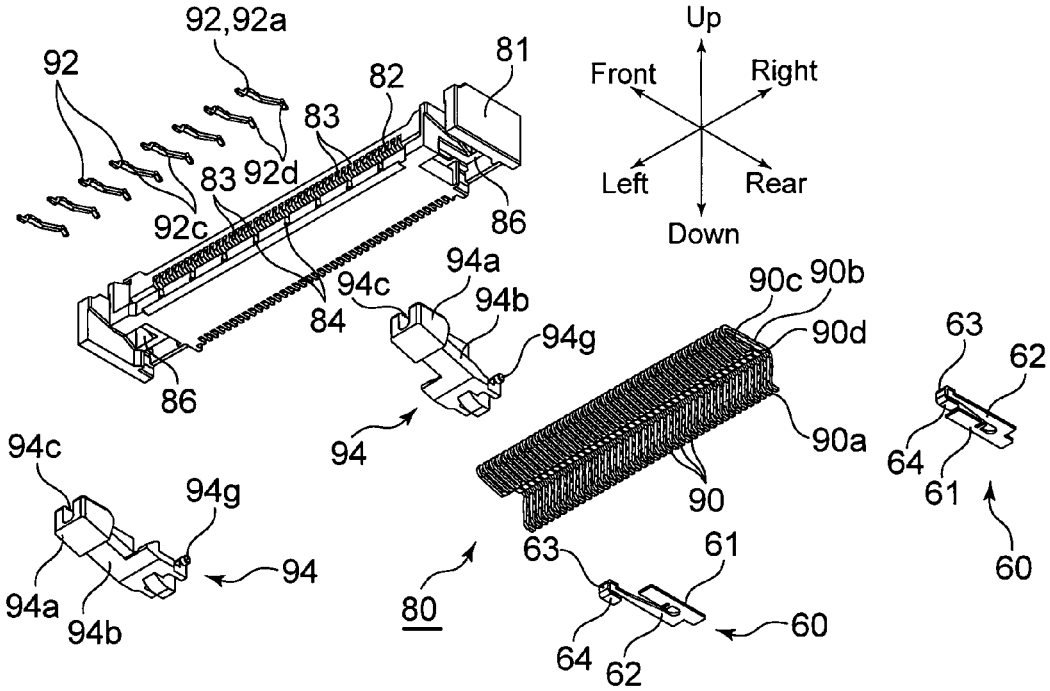
FIG. 22 is an exploded perspective view of a FPC connector, as viewed in an oblique direction from the front upper side thereof, according to a second embodiment of the present invention.
Figure 23:
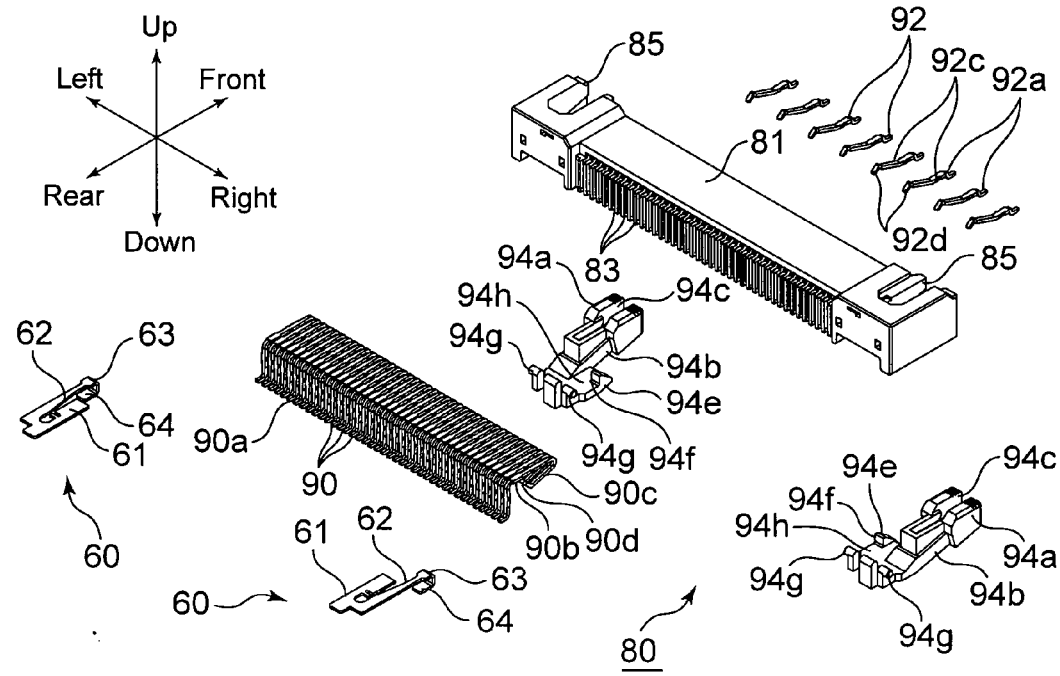
FIG. 23 is an exploded perspective view of the FPC connector, as viewed from the rear thereof.
Figure 24:
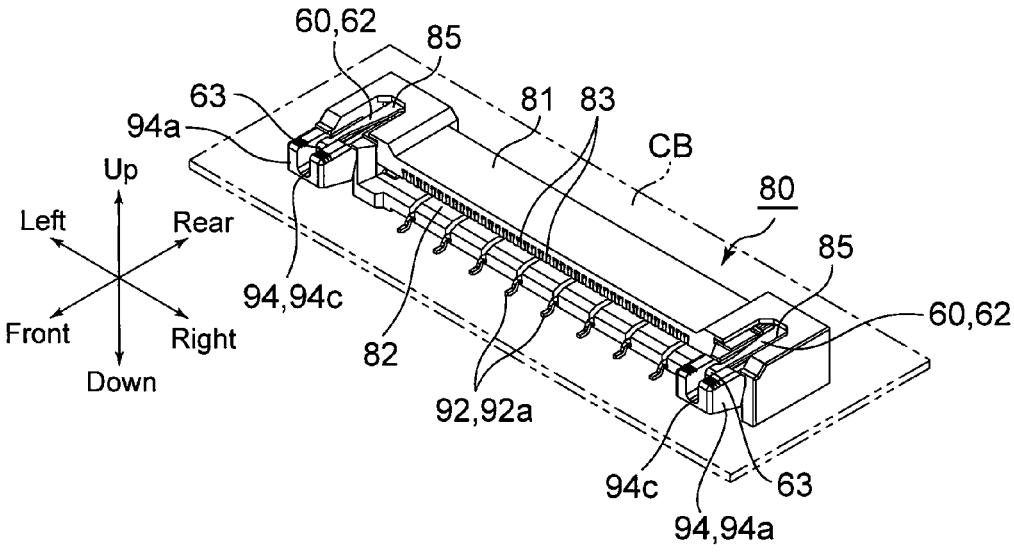
FIG. 24 is a perspective view of the FPC connector, as viewed from the front thereof, in which the lock members are positioned at the locked position.
Figure 25:
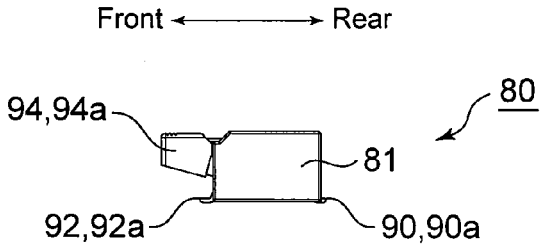
FIG. 25 is a side elevational view of the state shown in FIG. 24.
Figure 26:
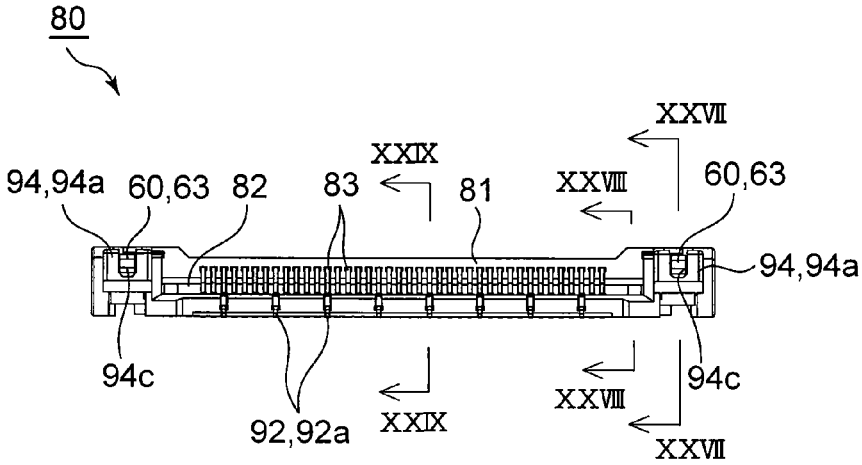
FIG. 26 is a front elevational view of the state shown in FIG. 24.

A second embodiment of the present invention will be hereinafter discussed with reference to FIGS. 22 through 24. Note that components/members that are the same as those in the first embodiment are denoted with the same designators, and detailed explanations thereof are omitted.

The cable connector of the second embodiment is a so-called "right-angle" (RA) FPC connector 80 which inserts a cable (FPC 70) in a direction parallel to a circuit board CB, onto which a connector is installed. The FPC connector 80 is provided with, as major components thereof, a pair of lock-member biasing springs 60, an insulator 81, signal contacts 90, ground contacts 92, and a pair of lock members 94.

The insulator 81, which is bilaterally symmetrical in shape, is formed out of the same material as that of the insulator 20 via injection molding. The insulator 81 is provided with an FPC insertion groove (cable insertion groove) 82 which is formed in the front surface of the insulator 81, forty (40) signal-contact insertion grooves 83 formed on the upper surface on the FPC insertion groove 82, eight (8) ground-contact insertion grooves 84 formed in the undersurface of the FPC insertion groove 82, a pair of left and right spring support grooves 85 formed in the upper surface of the left and right side portions of the insulator 81, respectively, a pair of left and right lock-member receiving recesses 86 formed in the undersurface of the left and right side portions of the insulator 81 and are communicably connected with the left and right side ends of the FPC insertion groove 82, respectively, and left and right rotational-shaft support recesses 87 formed upward in the base surfaces (upper surfaces) of the left and right lock-member receiving recesses 86.

A total of forty (40) signal contacts 90 are formed with the same material and in the same manner as that of the signal contacts 35. Each signal contact 90 is provided with a tail piece 90*a* extending in the forward/rearward direction, a press-fitting piece 90*b* extending forwards from the front end of a portion extending upwards from the font end of the tail piece 90*a*, and an elastically deformable piece 90*c* extending rearwards from the front end of press-fitting piece 90*b* and inclined in an downward direction; a bent contact projection 90*d* is formed at the vicinity of the rear end of the elastically deformable piece 90*c*.

Figure 29:
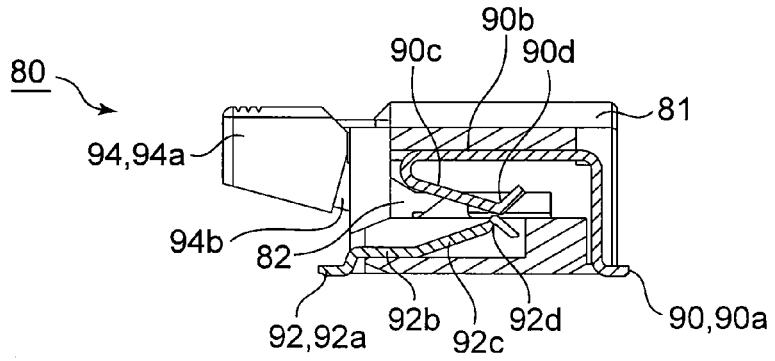
FIG. 29 is a sectional view taken along the XXIX-XXIX line shown in FIG. 26, viewed in the direction of the appended arrows.

Each signal contact 90 is fixedly fitted into a corresponding signal-contact insertion groove 83 by inserting the front end of the press-fitting piece 90*b* into the signal-contact insertion groove 83 from the rear opening of the signal-contact insertion groove 83 formed on the rear surface of the insulator 81, and by press-fitting the press-fitting piece 90*b* into the corresponding signal-contact insertion grooves 83. The elastically deformable piece 90*c* of each signal contact 90 is elastically deformable in the upward/downward direction within the corresponding signal-contact insertion grooves 83, and the contact projection 90*d* protrudes into the FPC insertion groove 82 when the elastically deformable piece 90*c* is in a free state (see FIG. 29).

A total of eight (8) ground contacts 92, which are formed with the same material and in the same manner as that of the signal contacts 35, are each provided with a tail piece 92*a* extending in the forward/rearward direction, a press-fitting piece 92*b* extending rearwards from the end of a part extending upwardly from the rear end of the tail piece 92*a*, and an elastically deformable piece 92*c* that extends rearwardly from the rear end of the press-fitting piece 92*b* while inclining upwardly; a bent pressing projection 92*d* is formed at the vicinity of the rear end of the elastically deformable piece 92*c*.

Each ground contact 92 is fixedly fitted into the corresponding ground-contact insertion grooves 84 by inserting the rear end of the elastically deformable piece 92*c* from the front opening of the corresponding ground-contact insertion groove 84 formed in the front surface of the insulator 81 and by press-fitting the press-fitting piece 92*b* into the corresponding ground-contact insertion groove 84. The elastically deformable piece 92*c* of each ground contact 92 is elastically deformable in the upward/downward direction within the corresponding ground-contact insertion groove 84, and the pressing projection 92*d* protrudes into the FPC insertion groove 82 when the elastically deformable piece 92*c* is in a free state (see FIG. 29).

The pair of left and right lock members 94, which are injection-molded (integrally molded) from the same material as that of the lock members 45, are mutually bilaterally symmetrical. The front portion of each lock member 94 is an operational portion (wide portion) 94*a*, and rotation-restricting portions (narrow-width portion) 94*b* having smaller dimensions in the leftward/rightward direction than those of the operational portions 94*a* project in a rearward direction from the rear surface of the operational portion 94*a*. The upper surfaces of the operational portions 94*a* and the rotation-restricting portions 94*b* are provided with a spring-engagement recess 94*c* which is open at the front end thereof, and an engaging portion 94*d* is formed inside the spring-engagement recess 94*c*. A lock claw 94*e*, which projects in the upward direction, is provided on an upper side of the rear portion of each lock member 94. The rear surface of each lock claw 94*e* constitutes a lock surface 94*f*, which is a flat surface lying on a plane that is orthogonal to the forward/rearward direction. Substantially cylindrical shaped rotational shafts 94*g* extending the leftward/rightward direction are formed at the rear end of each lock member 94.

Figure 27:
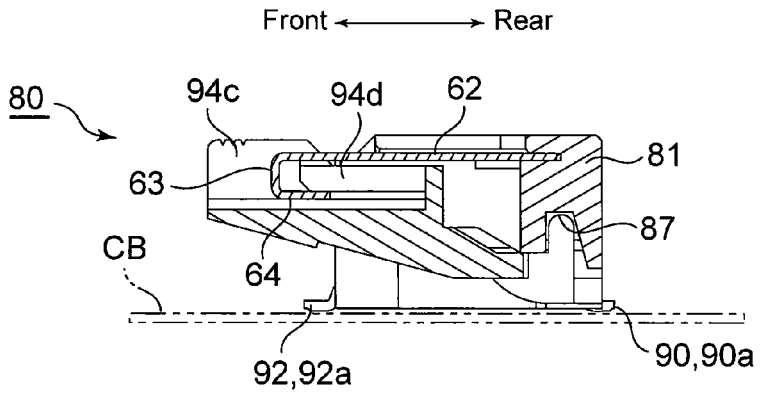
FIG. 27 is a sectional view taken along the XXVII-XXVII line shown in FIG. 26, viewed in the direction of the appended arrows.
Figure 28:
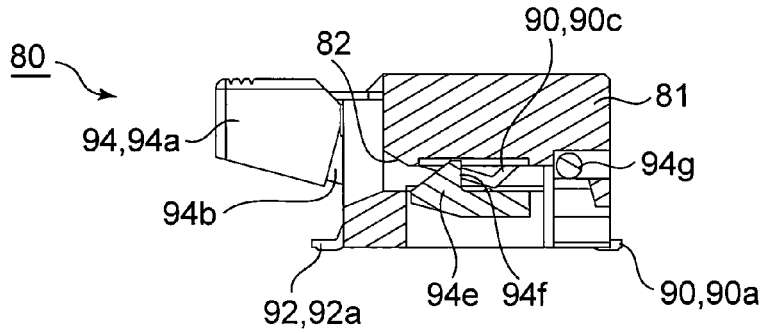
FIG. 28 is a sectional view taken along the XXVIII-XXVIII line shown in FIG. 26, viewed in the direction of the appended arrows.
Figure 30:
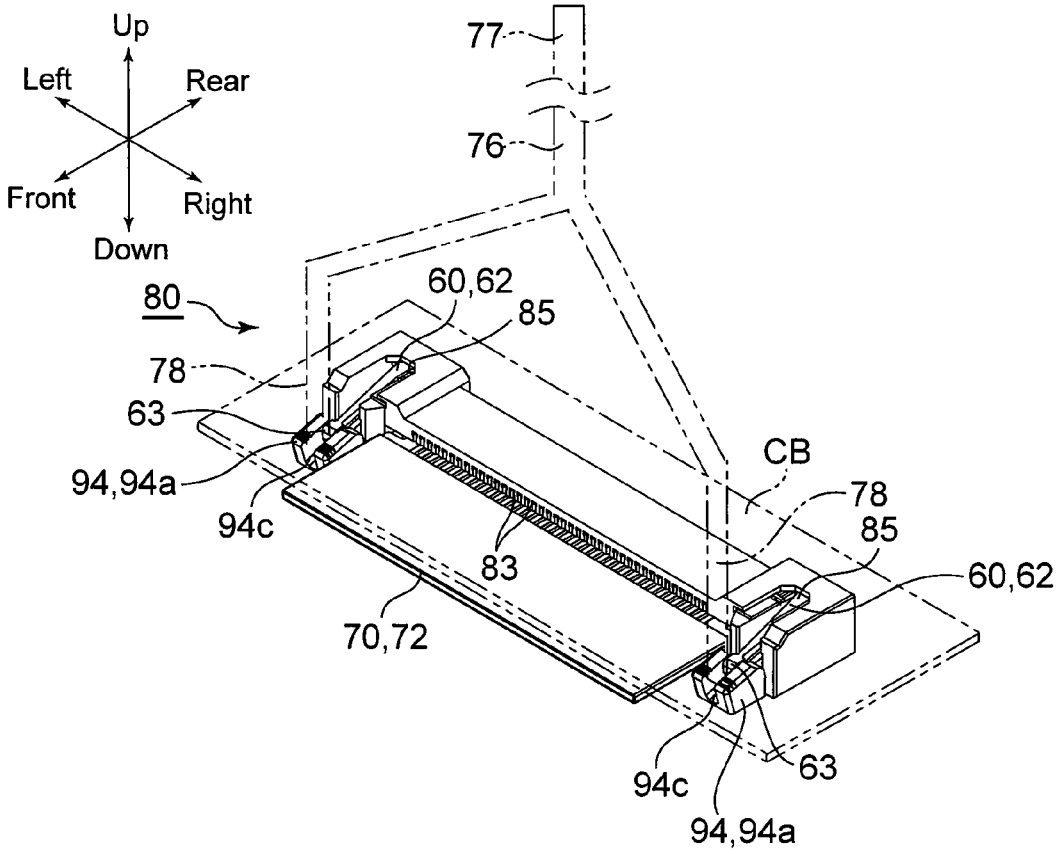
FIG. 30 is a perspective view similar to that of FIG. 24, of the FPC connector showing the lock members, which were positioned in the locked position, moved to the unlocked position by the insertion of the end of the FPC into the insulator or by the removal of the end of the FPC from the insulator.
Figure 31:
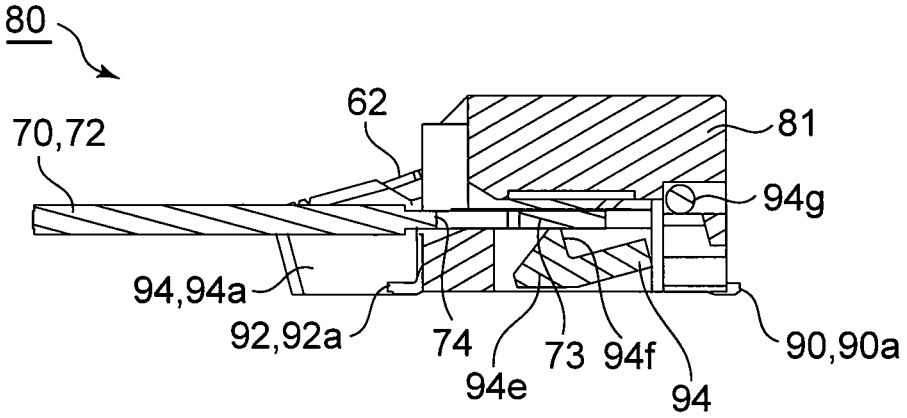
FIG. 31 is a sectional view similar to that of FIG. 30 in the state shown in FIG. 28.
Figure 32:
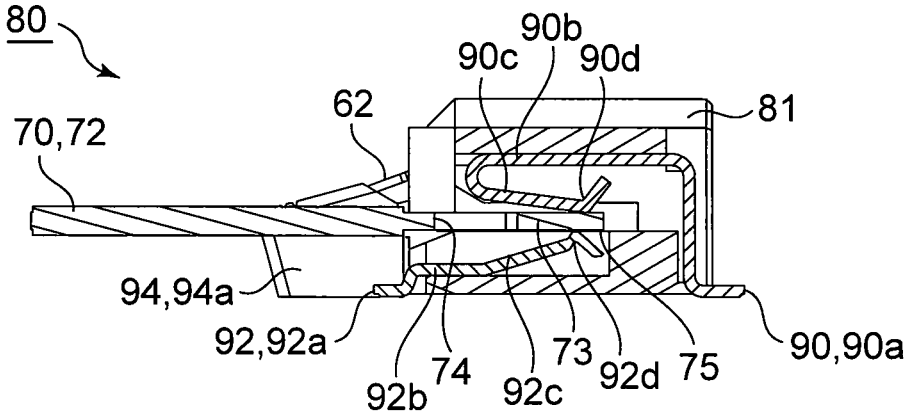
FIG. 32 is a sectional view similar to that of FIG. 30 in the state shown in FIG. 29.
Figure 33:
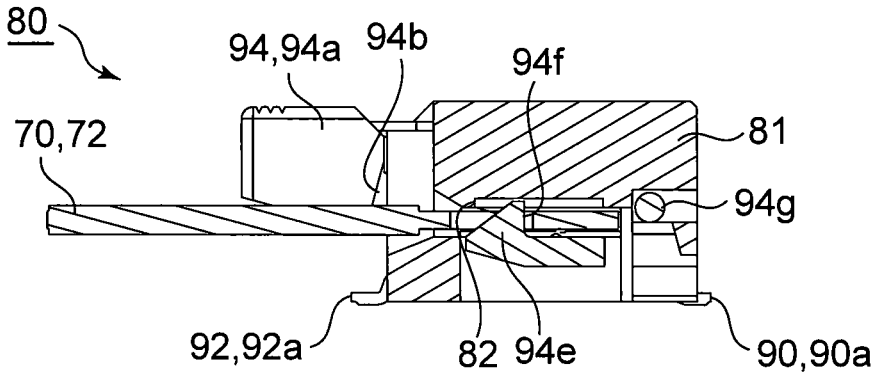
FIG. 33 is a sectional view similar to that of FIG. 28, of the end of the FPC fully inserted into the insulator.

The left and right lock members 94 are mounted to the insulator 81 (left and right rotational-shaft support recesses 87) to be rotatable about the axis of the rotational shafts 94*g* by positioning the left and right lock members 94 inside the left and right lock-member receiving recesses 86, respectively, from below except for the operational portion 94*a* thereof, and engaging from below the rotational shaft 94*g* with the corresponding left and right rotational-shaft support recesses 87, respectively (see FIG. 27; retainer projections which are the same as the above-mentioned retainer projections of the first embodiment are respectively formed inside the left and right rotational-shaft support recesses 87). The left and right lock members 94 are rotatable in an mutually independent manner, and are rotatable between the locked position shown in FIGS. 24 through 29, FIGS. 33 and 34, in which a lock-position restricting surface 94*h* of the lock members 94 contact each inner surface of the left and right lock-member receiving recesses 86, respectively, at a specified area, and the unlocked position shown in FIGS. 30 through 32. Note that the lock members 94 are rotatable further downward form the position shown in FIGS. 30 through 32; specifically, the lock members 94 are rotatable down to the position (not shown) at which the lower surfaces of the lock members 94 come into contact with the upper surface of the circuit board CB. In other words, the unlocked position of the lock members 94 is not limited to a specified single position (point), rather the unlocked position has a predetermined range of positions. As shown in FIGS. 28 and 33, when each lock member 94 is positioned at the locked position, each lock claw 94*e* enters into the end portion of the FPC insertion groove 82 through the corresponding lock-member receiving recess 86. Whereas, as shown in FIGS. 30 through 32, when the lock members 94 are rotated to the unlocked position, the lock claws 94*e* rotate downwardly from (toward the lock-member receiving recesses 86) the end portion of the FPC insertion groove 82 (if the lock members 94 are rotated to the unlocked position shown in FIGS. 30 through 32, part of each lock claw 94*e* remains in the end portion of the FPC insertion groove 82, and if the lock members 94 are rotated to the unlocked position at which the lower surfaces of the lock members 94 respectively come in contact with the upper surface of the circuit board CB, the entirety of each claw 94*e* is removed from the end portion of the FPC insertion groove 82).

The pair of left and right lock-member biasing springs 60 (although the specific shape thereof slightly differs from the lock-member biasing springs 60 of the FPC connector 10, the lock-member biasing springs 60 of the FPC connector 80 have the same designator since the functions thereof are essentially the same) is attached to the insulator 81 by fitting each base-plate portion 61 and each elastically deformable portion 62 into the respective left and right spring support grooves 85 from the front, and by fixing the rear end of each elastically deformable portion 62 and each base-plate portion 61 to the left and right spring support grooves 85, respectively, in a state in which the lock members 94 are positioned at the locked position with respect to the insulator 81. Upon the lock-member biasing springs 60 being attached to the insulator 81 (left and right spring support grooves 85), each engaging portion 64 enters into the associated spring-engagement recess 94*c* from the front, so that the upper surface of each engaging portion 64 comes in surface contact with the corresponding undersurface of the engaging portion 94*d* (see FIG. 27). Accordingly, when the lock members 94 are positioned at the locked position, the elastically deformable portion 62 of each lock-member biasing spring 60 is in a free state, extending parallel (or substantially parallel) to the forward/rearward direction (insertion/removal direction of the 70 into/from the FPC insertion groove 82), so that the lock members 94 are maintained at the locked position by the engaging portions 64 of the lock-member biasing springs 60.

The FPC connector 80 having the above-described structure can be installed onto the circuit board CB in the same manner as that of the FPC connector 10.

Hereinafter, the connection and connection-release operations of the FPC 70 (only one end and the close vicinity thereof is shown in FIGS. 30 through 34) to the FPC connector 80, and the connection and connection-release operations of the FPC connector 80 will be discussed.

As shown in FIGS. 30 through 32, when the edge portion of the FPC 70 (the distance (dimensions) in the upward/downward direction between the elastically deformable pieces 90*c* (contact projections 90*d*) in a free state and the lower surface of the FPC insertion groove 82 is smaller than the thickness of the FPC 70) is inserted into the FPC insertion groove 82 of the FPC connector 80, the end-edge surface of the FPC 70 (edge-reinforcement member 73) substantially simultaneously contacts the elastically deformable pieces 90*c* (directly in front of the contact projections 90*d*) of the signal contacts 90, the elastically deformable pieces 92*c* (positioned immediately in front of the pressing projection 92*d*) of the ground contacts 92, and the inclined surfaces of the lock claws 94*e* of the lock members 94.

Upon the FPC 70 being moved further rearward, as shown in FIGS. 31 and 32, the rear edge portion of the edge-reinforcement member 73 enters deeper inside (toward the rear end thereof) the FPC insertion groove 82 while elastically deforming the elastically deformable pieces 90*c* and the elastically deformable pieces 92*c* (while expanding the gap (distance) in the upward/downward direction formed between the contact projections 90*d* and the pressing projections 92*d*). Furthermore, since the left and right side edges of the edge-reinforcement member 73 press against the upper surfaces (inclined surfaces) of the left and right lock claws 94*e* of the left and right lock members 94, respectively, the lock members 94 rotate to the unlocked position while elastically deforming in the lower direction the elastically deformable portions 62 of the lock-member biasing springs 60, respectively.

Figure 34:
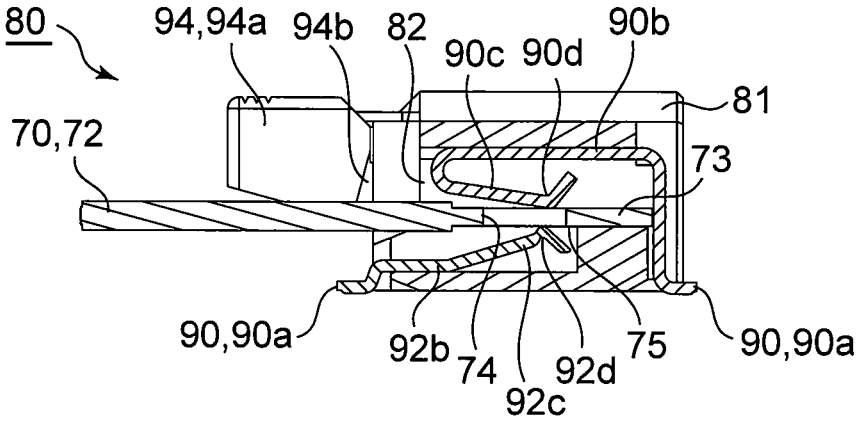
FIG. 34 is a perspective view similar to that of FIG. 29, of the end of the FPC fully inserted into the insulator.

Upon further rearward movement of the FPC 70, as shown in FIGS. 33 and 34, the edge-reinforcement member 73 enters deeper inside (rear end of) the FPC insertion groove 82. Furthermore, since the rear end portion of the edge-reinforcement member 73 rides over the left and right lock claws 94*e*, and the lock members 94 are rotatably returned to the locked position by the elastically deformable portions 62 of the lock-member biasing springs 60 elastically returning to its free state when the left and right engagement recesses 74 and the left and right lock claws 94*e* face each other in the upward/downward direction, the left and right lock claws 94*e* enter into the corresponding engagement recesses 74, respectively. Accordingly, even if an unintentional forward external force were to be applied against the FPC 70, since movement of the FPC 70 in an forward direction is prevented by the rear surfaces of the engagement recesses 74 coming in contact with (engaging with) the lock surfaces 94*f* of the lock claws 94*e*, respectively, the FPC 70 does not come out forwardly from the FPC connector 80. Furthermore, when the lock members 94 rotatably return to the locked position by the elastic force of the elastically deformable portions 62 of the lock-member biasing springs 60, a worker/technician, etc., can feel a strong tactile click.

Furthermore, since the circuit patterns 71 of the FPC 70 are in contact with the contact projections 90*d* of the signal contacts 90, electrical conduction between the FPC 70 and the circuit board CB can be carried out via the signal contacts 90. Furthermore, the pressing projections 92*d* of the ground contacts 92 come in contact with the ground terminals 75.

In the case where one wants to pull out the FPC 70 from the FPC connector 80 that is in a locked state, two fitting portions 78 of a lock-release jig 76 (the fundamental shape of which is the same as that of the first embodiment, except that the widths of the fitting portions 78 is slightly narrower than those of the first embodiment) shown in FIG. 3 are fitted into the spring-engagement recesses 94*c* of the left and right lock members 94, respectively, and the lock-release jig 76 is simply moved downwards. Accordingly, since the left and right lock members 94 are simultaneously rotated down to the unlocked position (see FIGS. 30 through 18), and the left and right lock claws 94*e* are released downwardly from the corresponding engagement recesses 74, the FPC 70 can be pulled forwards out from the insulator 81 (FPC insertion groove 82). After pulling out the FPC 70 from the FPC connector 80, if the pair of fitting portions 78 are removed away from the spring-engagement recesses 94*c* (of the lock members 94) by moving the lock-release jig 76 upwards, since the lock members 94 rotatably return to the locked position by the biasing force of the lock-member biasing springs 60, the FPC connector 80 automatically returns to the locked state.

As described above, since the FPC connector 80 of the second embodiment is also provided with the same fundamental structure as the FPC connector 10 of the first embodiment, substantially the same effects can be exhibited from the FPC connector 80 of the second embodiment to those of the FPC connector 10 of the first embodiment.

Note that also in the FPC connector 80 of the second embodiment, since the rotation-restricting portions 94*b*, which have narrow-width dimensions in the leftward/rightward direction, are positioned in between the left end surface of the insulator 81 and the left end surface of the FPC insertion groove 82, and in between the right end surface of the insulator 81 and the right end surface of the FPC insertion groove 82, the lock members 94 do not cause the FPC connector 80 to increase in size in the leftward/rightward direction.

Whereas, since the operational portions 94*a* which are positioned further forward from the front end of the insulator 81 (FPC insertion groove 82) have wider dimensions in the leftward/rightward direction than those of the rotation-restricting portions 94*b*, it is easy to carry the unlocking operation.

Furthermore, since it is possible to mount the lock members 94 and the lock-member biasing springs 60 to the insulator 81 by positioning the lock members 94 at the locked position by engaging from below the rotational shafts 94*g* with the left and right rotational-shaft support recesses 87, fitting the lock-member biasing springs 60 (the base-plate portions 61 and the elastically deformable portions 62) on the opposite side of the insulator 81 with respect to the lock members 94 into the ground-contact insertion grooves 84, respectively, from the front thereof, and inserting the engaging portions 64 into the spring-engagement recesses 94*c* from the front thereof (engaging with the engaging portions 94*d*), the procedure for assembling the lock members 94 and the lock-member biasing springs 60 onto the insulator 81 is easy.

Furthermore, unlike in the FPC connector 10 of the first embodiment, the FPC 70 and the circuit board CB can be electrically conductive with each other with the front end of the FPC 70 and the circuit board CB positioned substantially parallel to each other.

Although the present invention has been described using the above-described embodiments, the present invention is not limited thereto; the present invention can be implemented while making various modifications thereto.

For example, the thin object to be connected can be a cable other than a FPC cable, for example, a flexible flat cable (FFC).

Furthermore, in the illustrated embodiments, the FPC 70 can be prevented from being unintentionally pulled out by positioning the lock claws 53 or 94*e* of the lock members 45 or 94 into the engagement recesses 74 of the FPC 70, however, it is alternatively possible to form through-holes or recesses in one surface of the FPC 70 and to engage the lock claws 53 or 94*e* with the through-holes or recesses (in this case, the portion of the FPC 70 adjacent to the through-holes or recesses defines an engaging portion).

Furthermore, it is possible to form a protrusion member that is different from the lock claws 53 and 94*e* on the lock members 45 and 94 in order to rotate the lock members 45 and 94, positioned at the locked position, to the unlocked position by the cable pushing this member.

Instead of forming the jig recesses 55 on the lock members 45, it is possible to provide a flat surface (press-receiving portion) corresponding to each jig recess 55 having a surface finish that has a high frictional resistance, and these flat surfaces can be pressed by the fitting portion 78 of the lock-release jig 76.

Furthermore, it is possible to form indicator marks, corresponding to the indicator marks 29, on the insulator 81 of the FPC connector 80 so that these indicator marks cannot be visually confirmed in a plan view when the lock members 94 are positioned at the locked position, and so that these indicator marks can be visually confirmed in a plan view when the lock members 94 are positioned at the unlocked position.

Furthermore, it is possible to omit the ground contacts 40 and 92.

Other obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A cable connector comprising:

an insulator, into which a thin cable is removably insertable to thereby define a insertion/removal direction, said cable including a pair of engaging portions on each side edge thereof with respect to a lateral direction of said cable;

a plurality of signal contacts which are supported in said insulator, which is connected to a circuit board, wherein said signal contacts come in contact with said cable when said cable is inserted into said insulator;

a pair of lock members which are independently rotatable, relative to said insulator, between a locked position and an unlocked position, wherein each of said lock members are engageable with an associated said engaging portion at said locked position and are not engageable with said associated said engaging portion at said unlocked position; and a pair of springs which are supported on said insulator, wherein said springs retain said locked position of said lock members, respectively, and allow rotation of said lock members to said unlocked position by elastic deformation of said springs, respectively, wherein each of said springs includes a base-plate portion which is supported on said insulator, an elastically deformable portion which extends from said base-plate portion in a direction parallel to said insertion/removal direction of said cable, an end-extending portion which extends from an end of said elastically deformable portion in a direction that is different to the extending direction of said elastically deformable portion, and an engaging portion which extends from an end of said end-extending portion in a direction toward said base-plate portion and parallel to said elastically deformable portion, wherein said engaging portion engages with an associated said lock member to integrate said spring with said associated said lock member.

2. The cable connector according to claim 1, wherein a pair of rotational-shaft support recesses are formed on a surface of said insulator;

wherein said lock members are each provided with a rotational shaft which is rotatably fitted in a corresponding said rotational-shaft support recess, and wherein said elastically deformable portions of said springs are provided on the opposite side of said insulator with respect to said lock members, respectively.

3. The cable connector according to claim 1, wherein each of said lock members comprises a narrow-width portion, and a wide portion which is wider than said narrow-width portion in an arrangement direction of said lock members, and wherein a cable insertion groove is formed in said insulator, said cable insertion groove being positioned in between a pair of said narrow-width portions when viewed in said insertion/removal direction.

4. The cable connector according to claim 1, further comprising at least one ground contact, wherein said ground contact comes in contact with said cable when said cable is inserted into said insulator.

5. The cable connector according to claim 1, further comprising a pair of indicator marks formed on said insulator, wherein, when viewed in said insertion/removal direction of said cable, said indicator marks are covered by said lock members when said lock members are positioned at said locked position, and said indicator marks are exposed by said lock members when said lock members are positioned at said unlocked position.

6. The cable connector according to claim 1, further comprising a press-receiving portion formed on each of said pair of lock members, wherein said press-receiving portions can be pressed and operated by a pair of pressing portions formed on a single lock-release jig.

7. The cable connector according to claim 6, wherein each of said press-receiving portions comprises a jig recess, wherein said pressing portions are engageable with said jig recesses, respectively.

* * * * *